US005748080A

United States Patent [19]

Clay

[11] Patent Number: 5,748,080

[45] Date of Patent: May 5, 1998

[54] OVERBOARD SAFETY DEVICE

[76] Inventor: Charles Matthew Clay, 1451 Joyce Rd., Mobile, Ala. 36618

[21] Appl. No.: 723,089

[22] Filed: Sep. 30, 1996

[51] Int. Cl.[6] ..... G08B 1/08

[52] U.S. Cl. ..... 340/539; 340/571; 340/572; 340/573; 340/693; 340/604; 362/158; 362/183

[58] Field of Search ..... 340/539, 573, 340/572, 571, 604, 605, 691, 693; 441/80; 362/158, 183; 320/48, 14; 455/128

[56] References Cited

U.S. PATENT DOCUMENTS

| | | | |
|---|---|---|---|
| 4,275,385 | 6/1981 | White | 340/312 |
| 4,702,715 | 10/1987 | Winick | 441/80 |
| 5,006,831 | 4/1991 | de Solminihac | 340/573 |
| 5,029,293 | 7/1991 | Fontanille | 340/573 |
| 5,059,952 | 10/1991 | Wen | 340/573 |
| 5,210,525 | 5/1993 | Lennon et al. | 340/604 |
| 5,274,359 | 12/1993 | Adams | 340/604 |

*Primary Examiner*—Jeffery Hofsass
*Assistant Examiner*—Daryl C. Pope
*Attorney, Agent, or Firm*—Patent & Trademark Services; Thomas Zack; Joseph H. McGlynn

[57] ABSTRACT

A safety signaling device, usable by persons would fall overboard from a vessel, with a rechargeable battery activated by the present of water to transmit both a light signal and a radio signal. A housing contains both transmitting sources and has spaced sets of probe contacts to recharge the unit. Reset and test buttons are also provided on the housing's front to reset the operating transmitters and to test their performance.

5 Claims, 1 Drawing Sheet

OVERBOARD SAFETY DEVICE

BACKGROUND OF THE INVENTION

Locating persons lost in the water has been something sailors have tried to do since man first started to venture on the water. Some recent developments have focused on items worn by the individual, such as personal alarms, that will become activated when exposed to water. The alarms themselves may take on a variety of forms such as visual or audio indicators or may transmit radio signals to fix the location of the person in distress. In any event, a self-contained power source, usually a battery, is needed to operate them for the duration of their performance. Unless a person is prudent enough to carry spare batteries with them and have them easily accessible, the alarm may loose it potential value for lack of an effective power supply. The present invention relates to a visual alarm activated by water whose power source is rechargeable thus insuring its availability when needed as described herein.

DESCRIPTION OF THE PRIOR ART

Concerns over water safety have prompted the development of many inventions which indicate a person is in need of assistance. For example, in U.S. Pat. No. 5,006,831 to de Solminihac, an acoustic signal beacon placed beneath a boat's hull can be activated when a person with a worn alarm pack falls overboard. Further, U.S. Pat. No. 5,029,293 to Fontanille, discloses a helmet with a dye, lamp and radio transmitter which are activated when a person falls into the water. Another device, U.S. Pat. No. 5,059,952 to Wen, discloses a survivor locator light with water-activated switches. And in U.S. Pat. No. 5,274,359 to Adams a water activated alarm and directional plus proximity indicator is disclosed. The present invention provides for a man overboard light, which can be coupled with a radio transmitter, having a pair of water activated contacts and a rechargeable unit for the power source all as more fully set forth in this specification.

SUMMARY OF THE INVENTION

This invention relates to a water activated light having a self-contained power source which is rechargeable. A rechargeable unit to provide power to the power source used with the light and, if desired, a radio transmitter. Other features and accessories, including a test button for the power source used to check its power level, may also be used.

It is the primary object of the present invention to provide for an improved water activated visual alarm.

Another object is to provide for such an alarm whose power source is rechargeable and which may be combined with a transmitter to assist in locating a person in the water.

These and other objects and advantages of the present invention will become apparent to readers from a consideration of the ensuing description and the accompanying drawings.

DESCRIPTION OF THE PREFERRED EMBODIMENT

Figure 1:
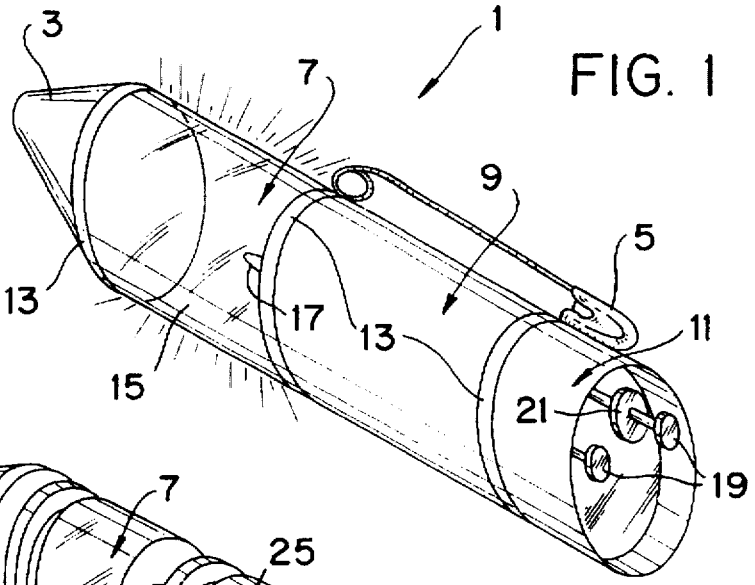
FIG. 1 is a side perspective view of the invention's preferred embodiment.

FIG. 1 is a side perspective view of the invention's preferred embodiment. An elongated high impact ABS ( Acrylonitrile-butadiene-styrene) plastic housing 1 has a cone shaped nose 3 and a stainless steel safety-type pin 5 used to attach the unit to a user's clothing. The housing has four sections including the front nose section 3, the light transmitting lens section 77 the power source section 9 and the rear probe section 11. Each section is threaded into its adjacent section with a rubber O-ring 13 at the interface to insure a water tight seal between sections.

The cone shaped front nose section 3 houses a conventional radio transmitter with an effective range of about 3000 feet, frontal reset and test buttons and circuitry to permit the operation of the transmitter. Behind the nose section is the light transmitting section 7 having a clear Lexan plastic outer cylindrical lens 15 and an inner strobe light source 17. Next, is the power source cylindrical section 9 which houses one or more self-contained rechargeable batteries used to supply power to the strobe light and, via a concealed conventional wire connection arrangement, the nose housed radio transmitter.

The rear cylindrical probe section 11 has necessary electrical contact probes used to recharge the power source and to sense the presence of water. The outer probes 19 serve to activate the unit's electrical system when immersed in water while the inner probes 21 are used to recharge the unit. Both probes are recessed from the housing's 11 opened end by approximately one inch to prevent accidental activation of the unit by rain or other moisture.

Figure 2:
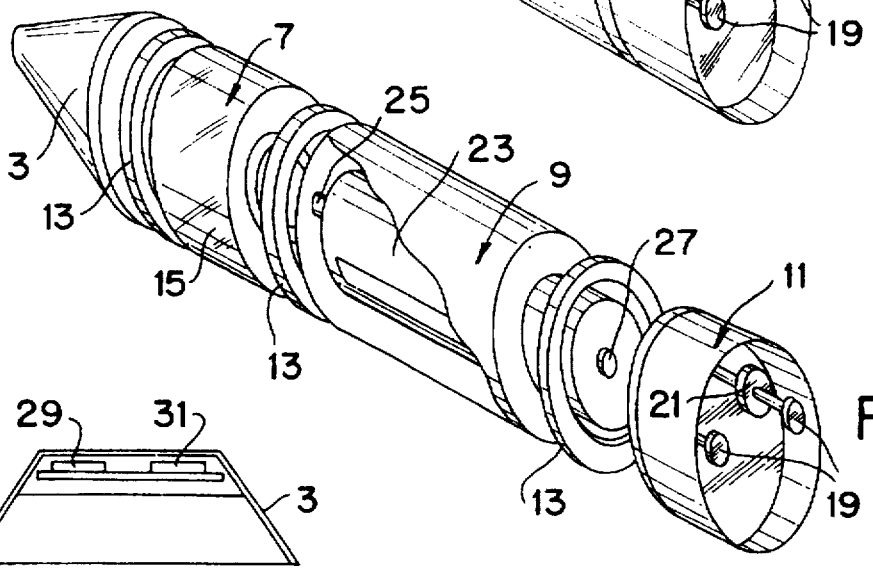
FIG. 2 is an exploded side perspective view of the FIG. 1 embodiment with a section of its side removed to view its power source.

FIG. 2 is an exploded side perspective view of the FIG. 1 embodiment with a section of its side removed to show its power source. The outside attachment clip 5 has been removed to aid in its understanding. In addition to the previous described components, the partial sectional view of the self-contained power source section 9 contains a rechargeable battery 23 such as a nickel cadmium (NI—CAD) battery. At its front end 25 this battery is connected to the strobe light 17 and the radio transmitter in nose section 3 while its rear end 27 interconnects to the probe section 11.

Figure 3:
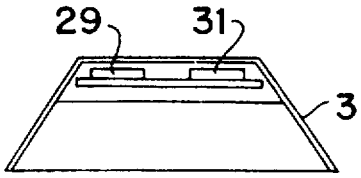
FIG. 3 shows a cross sectional side view of the alarm's nose piece.

At the very front of nose section 3 are two buttons as shown in FIG. 3. One is a reset button 29 when used to reset the unit to its initial state and the other button 31 is used to test the unit to see that its battery has sufficient power to emit strobe light and transmit a radio signal. Each button is electrically connected internally of housing 1 to the power source.

Figure 4:
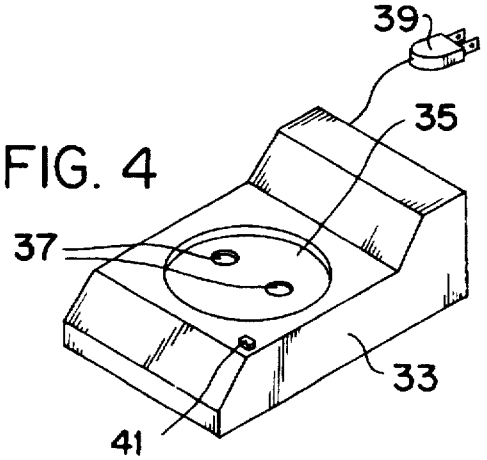
FIG. 4 shows a battery recharge unit which can be used to recharge the FIG. 1 power source.

FIG. 4 shows a battery recharge unit which can be used to recharge the FIG. 1 power source. The recharge base 33 has a circular indented section 35 adapted to receive the section 11 probe end. Two power hollow ring contacts 37 within section 35 are positioned to engage the two recessed recharge probes 21 of section 11. A lower down set of spaced recessed contacts within the outline of the ring are located on the base of section 35 and engage the outer probe contacts 19. A plug 39 is used to contact to a standard AC house current socket (i.e., about 15 amperes and 110 volts) which is internally converted in unit 33 by a copper oxide or selenium disk type rectifier to direct current to charge a mounted battery. The LED (light emitting diode) light 41 indicates the unit is on and recharging is taking place. Once, the recharging has take place and the battery is charged, the light 41 would go off and the battery can be removed for insertion into the power section 9.

Figure 5:
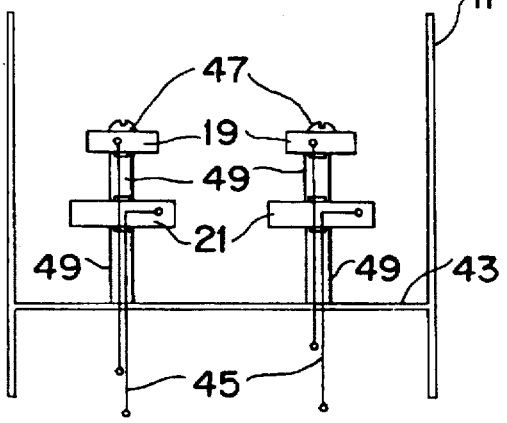
FIG. 5 is a side sectional view of the probe section contacts.

FIG. 5 is a side sectional view of the probe section 11 contacts. The recessed probes are attached to a base 43 through which wires 45 extend which go the internal conventional rectifier and other circuit elements. A hollow nylon screw 47 fastens each of the spaced two base insulated probe extensions to the base 43. Internally separate electrically insulated wires contact the outer exposed probe contact 19 to its internal electronics and the larger inner exposed contact 21 to its internal electronic circuit. Tubular electric and moisture insulation is provided between these two sets of wires and the exterior surfaces at the areas 49 on the two upright probes.

The outer smaller probe contacts 19 electrically activate the unit when water builds-up between their two spaced ends, such as by immersion in a ocean. The two larger inner probes contacts 21 are used to recharge the battery by placing them in contact for a sufficient time with the two contacts 37 (see FIG. 4). Contacts 37 may be configured to engage the circular probe contacts by making them shaped like a hollow ring which abuts the contacts 21 while allowing the smaller outer contacts 19 to fit within the ring. A second set of electrical contacts within this ring but lower down on the recharge unit would contact the contacts 19 which fit through the ring.

In use a person would pin the fully charged housing to their clothing or life vest while sailing when their is a concern that there is a danger of falling overboard or the vessel sinking. The total length of one embodiment for the housing is between 6 to 8 inches. Should the user fall overboard or the vessel sink, the water between the electrodes 19 would activate the electronic circuitry to activate the strobe light 17 and the radio transmitter in section 3. A remote receiver (not shown) located either on the vessel or within the range of the emitted radio signals would be activated by the transmitted signal and would emit an audible signal and illuminate its own strobe light. After rescue has occurred, the recovered unit 1 could be deactivated by pressing reset button 29 and its battery tested by pressing test button 31. Test button could also be used, without probe contacts 19 exposed to water, to activate both the light and radio transmitter The primary components for housing 1 and its clear Lexan lens 16 would best be manufactured of high-impact ABS plastic using the plastic injection molding process. Injection molding is a plastic molding process whereby heat softened plastic material is forced under very high pressure into a metal cavity mold, usually aluminum or steel, which is relatively cool. The inside cavity of the mold is comprised of two or more halves, and is the same desired shape as the product to be formed ( in this case the housing sections and lens). High pressure hydraulics are used to keep the mold components together during the actual injection phase of the molding process. The injected plastic is allowed to cool and harden in the mold. The hydraulics holding the multiple component mold cavity together are released, the mold halves are separated and the solid formed plastic item is removed. Injection molding can be highly automated process and is capable of producing extremely detailed parts at a very cost effective price. The process should be invaluable in producing this invention's preferred embodiment cost effectively.

The internal electronics used with the preferred embodiment can be manufactured using fiberglass printed circuit boards using a combination of conventional and surface mount electronic components. Surface mount components are much smaller than conventional electronic components but perform the same electrical function. Components, one installed (either by hand or robots), are mass soldered to the printed circuit board using either the wave soldering process or the drag soldering process.

The transmitter and its receiver can operate on a 49 MHz (Megahertz) frequency range and should use a digitally encoded signal. This frequency is used for low power walkie-talkies and cordless telephone applications. Such frequencies will not interfere with the unit's internal electronics as the digital tone is the intelligent part of the transmitted signal being responded to in the receiver/alarm circuit.

Although the invention's preferred embodiment and the method of using the same according to the present invention has been described in the foregoing specification with considerable details, it is to be understood that modifications may be made to the invention which do not exceed the scope of the appended claims and that modified forms of the present invention done by others skilled in the art to which the invention pertains will be considered infringements of this invention when those modified forms fall within the claimed scope of this invention.

What I claim as my invention is:

1. A water activated safety apparatus comprising:

a water tight housing having a rechargeable self-contained electric power source;

a water activated light source powered by said power source and located within said housing, said light source being activated by the presence of water external to the housing; and means for recharging said power source and sensing the presence of water external housing water, said means having a probe extending externally from the housing with inner and outer contacts to both permit the recharging of the power source and to sense the presence of water to activate the light source.

2. The invention as claimed in claim 1, wherein said probe's contacts are located within a recess on the rear of said housing.

3. The invention as claimed in claim 2, wherein said housing has a water-tight light transmitting lens with said light source mounted within it to transmit light through the lens.

4. The invention as claimed in claim 3, wherein said housing also has a radio frequency transmitter whose transmitted signal is sent in response to water on said probe's external inner and outer contacts.

5. The invention as claimed in claim 4, wherein said housing also has reset and test buttons, said reset button being able to reset the light and radio transmitting housing to its initial non transmitting state and said test button being capable of test the transmitting of light from said light source and the sending of radio signals from said radio transmitter.

* * * * *